United States Patent [19]

Diaz

[11] Patent Number: 4,759,544

[45] Date of Patent: Jul. 26, 1988

[54] AQUATIC EXERCISE APPARATUS

[76] Inventor: Manuel S. Diaz, 9011 Rue Crillon, Houston, Tex. 77074

[21] Appl. No.: 783,167

[22] Filed: Oct. 2, 1985

[51] Int. Cl.[4] ..... A63B 21/00

[52] U.S. Cl. ..... 272/93; 272/73; 272/71; 272/116

[58] Field of Search ..... 272/71, 93, 116, 130, 272/73, 69; 119/29

[56] References Cited

U.S. PATENT DOCUMENTS

| | | | |
|---|---|---|---|
| 3,485,213 | 12/1969 | Scanlon | 272/69 |
| 3,534,413 | 10/1970 | Plasseraud | 272/71 |
| 4,332,217 | 6/1982 | Davis | 272/71 |
| 4,411,422 | 10/1983 | Solloway | 272/71 |
| 4,551,108 | 11/1985 | Bass | 272/71 |
| 4,576,376 | 3/1986 | Miller | 272/69 |

FOREIGN PATENT DOCUMENTS

| | | | |
|---|---|---|---|
| 2037100 | 2/1972 | Fed. Rep. of Germany | 272/73 |
| 2818020 | 11/1979 | Fed. Rep. of Germany | 272/73 |
| 3042660 | 6/1982 | Fed. Rep. of Germany | 272/93 |
| 3127173 | 1/1983 | Fed. Rep. of Germany | 272/93 |

*Primary Examiner*—Richard J. Apley
*Assistant Examiner*—J. Welsh
*Attorney, Agent, or Firm*—Kenneth A. Roddy

[57] ABSTRACT

An aquatic exercise apparatus for strengthening muscles while simultaneously providing hydrotherapeutic massage to the occupant comprises an enclosure filled with a liquid and an exercise device disposed within the enclosure which when operated in the liquid produces hydrodynamic resistance, deflection of the liquid, fluid resistance, and generation of fluid currents and turbulence within the enclosure. The enclosure bottom and side wall are adapted to cooperate with fluid currents generated by the occupant and exercise device when operated in the liquid to assist in generation of fluid currents and turbulence within the enclosure. The occupant's body movements also produce hydrodynamic resistance, deflection of the liquid, fluid resistance, and generation of fluid currents and turbulence within the enclosure, and as a result of the movements of the occupant and the exercise device, the occupant receives beneficial hydrotherapeutic massage on the submerged body portions by the liquid motion thus generated within the enclosure. Medicants may be introduced into the liquid medium to supplement the beneficial effect of the occupant's hydrotherapeutic massage. Additives may also be introduced into the liquid medium to alter the fluid flow and buoyancy characteristics of the liquid, and alter physical stress during exercise. Sensors may be coupled to the exercise device and occupant for monotoring the operation of the device, and physical status of the occupant during exercise periods.

1 Claim, 3 Drawing Sheets

AQUATIC EXERCISE APPARATUS

BACKGROUND OF THE INVENTION

1. Field of the Invention

This invention relates generally to exercise apparatus, and more particularly to an aquatic exercise apparatus having an enclosure and an exercise device disposed therein for providing exercises in a liquid medium whereby the occupant simultaneously generates fluid currents and turbulence within the enclosure, and as a result of the movements of the occupant and the exercise device, the occupant receives hydrotherapeudic message on the submerged body portions by the liquid motion thus generated within the enclosure.

2. Brief Description of the Prior Art

The benefits of aerobic exercise and particularly jogging are well known. Jogging is not suggested for persons who are prone to back, knee, and foot problems because the inherent impact of the feet on the ground surface is often the cause of peripheral vascular insufficiency or injury to the legs, ankles, and back. Invalids, osteoarthritic, and postoperative patients are given alternative forms of exercise such as swimming, which does not necessarily exercise the muscles which come into play in running or jogging.

Aquatic exercise, and jogging apparatus are known in the art. There are several patents which disclose devices which are used for exercising in water, and jogging devices used out of water.

Scanlon, U.S. Pat. No. 3,485,213 discloses an animal therapy, exercising and conditioning apparatus having a motor driven tread mill at the bottom of a liquid filled tank wherein an animal is forced to run in a liquid medium, and wherein the speed of movement of the animal as well as the resistance of the the medium may be varied by the operator. Scanlon teaches "forced" exercise and elimination of agitation in the tank.

Solloway, U.S. Pat. No. 4,311,306 discloses several devices which resemble known sports equipment, such as dumbells, baseball bats, golf clubs, etc., constructed to generate resistance to movement through water. Movement of these devices through water is intended to generate pressure heads and fluid resistance to such movement.

Baker, U.S. Pat. No. 3,913,907 discloses two pairs of finlike members that may be worn on the hands or feet of a user exercising in water. The fin members provide resistance to motion through water and stress to the arms and legs. Each of the members has a valve arrangement to vary the amount of fluid which may pass through the member when exercising.

Ward, U.S. Pat. No. 3,427,022 discloses a buoyancy device which may be used to support a person in water whereby the person may then exercise. the degree of bouyancy may be adjusted by adding water to the floatation device.

Dunn, U.S. Pat. No. 3,501,500 discloses an exercise device operable by the feet or hands of the user. Force is applied by the user on pad members at the extremities of a beam mounted on an oscillatable shaft and adjustable braking means are positioned on the shaft to provide variable resistance to the oscillation of the shaft. The device is not suggested to be used in a water environment.

The following patents are directed toward exercise devices for use on ground surfaces wherein springs or other mechanical devices are utilized to provide resistance. They do not suggest their usage in an aquatic environment.

Garcia, U. S. Pat. No. 3,628,791 discloses a jogging device having a pair of pedals or platforms pivoted at one end and supported by coil springs.

Cummins, U.S. Pat. No. 3,659,844 discloses a pivotal rocking platform wherein resistance to the rocking motion is provided by springs.

Katz, U.S. Pat. No. 4,279,415 discloses a pedal arrangement intended as a jogging device wherein coil springs are used to maintain the foot treadles in an upright position pivoted about one end of each treadle, and to return the treadles to this position upon lifting the foot. Crushable material is utilized to absorb the force of the jogger's downward stroke.

The above noted patents are directed toward apparatus for forced exercise in a liuqid medium, devices for providing resistance when moved through water in exercise movements, and toward apparatus for exercise in place on a ground surface by jogging type movements wherein resistance to the related downward motion by the user is provided by resilient material, which may include springs and other mechanical devices.

The present invention is distinguished over the prior art and these patents in that the present invention provides an aquatic exercise apparatus comprising an enclosure filled with a liquid medium and an exercise device disposed within the enclosure which when operated in the liquid produces hydrodynamic resistance, deflection of the liquid, fluid resistance, and generation of fluid currents and turbulence within the enclosure. The occupant when operating the exercise device in the liquid also produces hydrodynamic resistance, deflection of the liquid, fluid resistance, and generation of fluid currents and turbulence within the enclosure, and as a result of the movements of the occupant and the exercise device, the occupant receives a beneficial hydrotherapeudic massage on the submerged body portions by the liquid motion thus generated within the enclosure.

SUMMARY OF THE INVENTION

It is therefore an object of the present invention to provide an aquatic exercise apparatus which provides the muscular exercise and aerobic benefits of running with reduced stress and harmful effects on the skeletal members which are common when running on a ground surface.

It is another object of this invention to provide an aquatic exercise apparatus which combines hydrodynamic muscular exercise and aerobic benefits of running with hydrotherapeudic massage generated by the user's body movements.

Another object of this invention is to provide an aquatic exercise apparatus for strengthening muscles, improving muscle tone and coordination, while simultaneously providing hydrotherapeudic massage to the occupant.

Another object of this invention is to provide an aquatic exercise apparatus wherein the occupant operating an exercise device in a liquid medium produces hydrodynamic resistance, deflection of the liquid, fluid resistance, and generation of fluid currents and turbulence within an enclosure, and as a result of the movements of the occupant and the exercise device, the occupant receives a beneficial hydrotherapeutic massage on the submerged body portions by the liquid motion thus generated within the enclosure.

Another object of this invention is to provide an aquatic exercise apparatus wherein medicants may be introduced into the liquid medium to suppliment the beneficial effect of hydrotherapeudic massage on the occupants submerged body portions.

Another object of this invention is to provide an aquatic exercise apparatus wherein the fluid flow and bouyancy characteristics of the liquid medium may be altered to increase or decrease the physical stress during exercise.

Another object of this invention is to provide an aquatic exercise apparatus wherein sensing means may be coupled to an exercise device within the apparatus for monotoring the operation of the device, and sensors may be coupled to the occupant for monotoring the physical status of the occupant during, and relative to, the operation of the exercise device.

A further object of this invention is to provide an aquatic exercise apparatus which provides an improved form of physical therapy for postoperative and osteoarthritic patients.

A still further object of this invention is to provide an aquatic exercise apparatus which is attractive in appearance, simple in construction, economical to manufacture, and rugged and durable in use.

Other objects of the invention will become apparent from time to time throughout the specification and claims as hereinafter related.

The above noted objects and other objects of the invention are accomplished by the present aquatic exercise apparatus having an enclosure and an exercise device disposed therein for providing exercises in a liquid medium whereby the occupant simultaneously generates fluid currents and turbulence within the enclosure, and as a result of the movements of the occupant and the exercise device, the occupant receives hydrotherapeudic massage on the submerged body portions by the liquid motion thus generated within the enclosure.

DESCRIPTION OF THE PREFERRED EMBODIMENT

Figure 1:
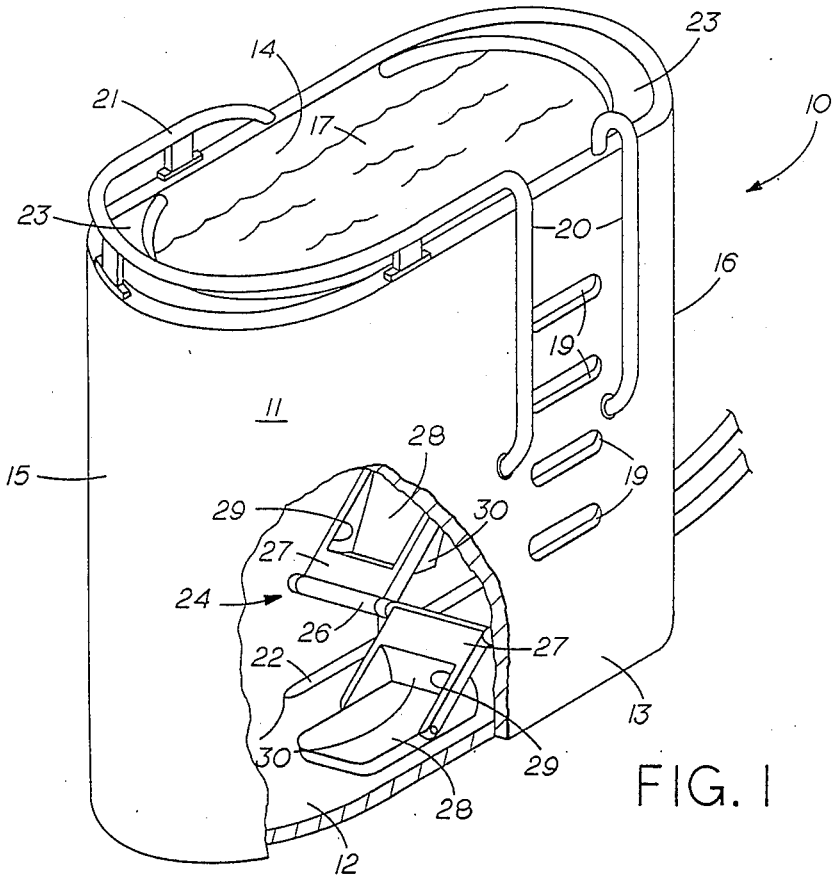
FIG. 1 is an isometric view of a preferred aquatic exercise apparatus with a portion of the side wall cut away.

Referring to the drawings by numerals of reference, and particularly FIGS. 1 through 6, there is shown a preferred aquatic exercise apparatus 10. The apparatus 10 comprises a tank 11 having a bottom 12, spaced side walls 13 and 14 and curved end walls 15 and 16. The tank 11 may be formed of molded plastic and is approximately three to four feet in height, approximately three to four feet in length, and approximately two to three feet wide. The tank 11 is filled by conventional means with a suitable liquid medium 17 such as water. The liquid medium may be heated by the conventional means and medicants may optionally be added to the liquid. The liquid may also be be provided with additives to alter the bouyancy and viscosity properties. The tank 11 provides an enclosure which will surround the body of the user 18 in a manner to allow complete leg movement yet providing a relatively confined enclosure to provide maximum hydrotherapeudic massage action from the liquid contents as described hereinafter.

The tank 11 may be provided with steps 19 along the exterior of one side wall, and a vertical hand rail 20 for safety and ease of entry into the tank. A hand grip rail 21 may be extend around the top edge of the front end wall 15 and a portion of the side walls 13 and 14 for the occupant to grip when exercising.

As shown in FIGS. 2, 4, 5, and 6, the interior of the tank 11 is provided with a longitudinally extending raised portion 22 along the bottom 12, and the interior bottom surface is curved at the juncture of the side walls 13 and 14 and end walls 15 and 16. The interior top portion of the end walls 15 and 16 are curved inwardly to form curved retaining ledges 23 to prevent the liquid medium 17 from being splashed out during periods of vigorous exercise.

Figure 2:
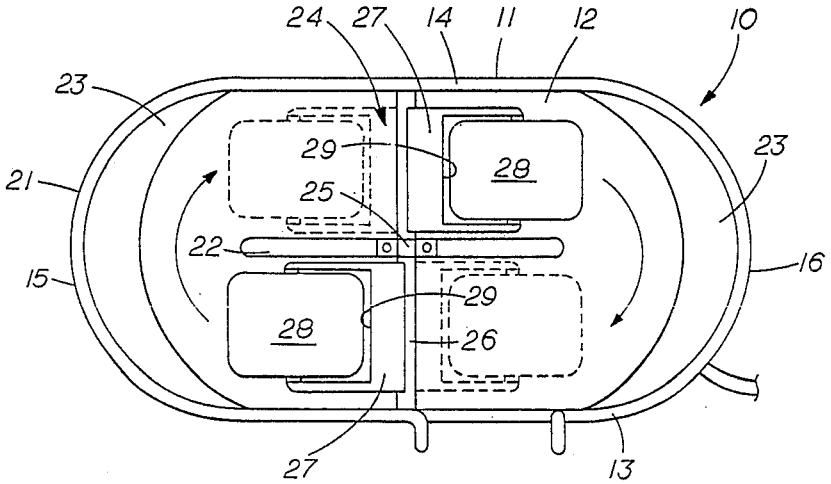
FIG. 2 is a top plan view of the aquatic exercise apparatus of FIG. 1.
Figure 3:
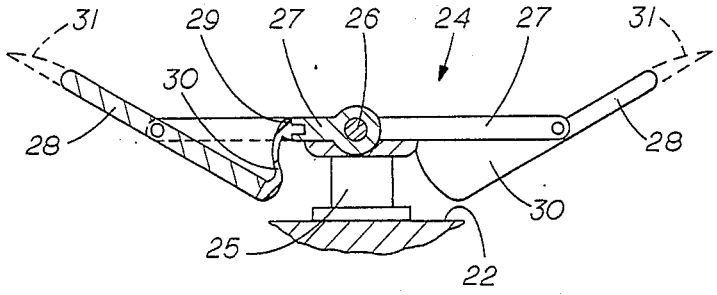
FIG. 3 is a side elevation in cross section of the foot pedal details of the aquatic exercise apparatus.
Figure 6:
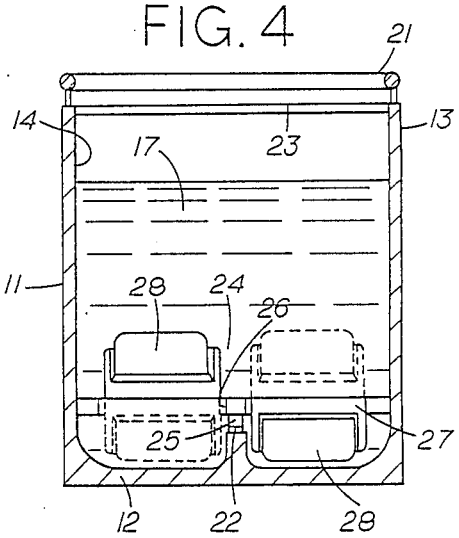
FIG. 6 is a front elevational view in cross section of the aquatic exercise apparatus.

As best shown in FIGS. 2, 3, and 6, an exercise platform 24 is secured in the center of the tank on the raised bottom portion 22. The exercise platform 24 comprises a base member 25 upon which a horizontal main shaft 26 is pivotally mounted. The ends of the main shaft 26 are pivotally secured to the interior surface of the side walls 13 and 14. A pair of laterally spaced lever arms 27 are attached in opposed relation to the main shaft 26.

A foot pedal 28 is pivotally mounted within cut out portions 29 of each lever arm 27. A flexible elastomeric membrane 30 connects the foot pedals 28 with the cut out portion 29 of the lever arms 27 in a spaced relation. The membrane 30 fills the open area between the foot pedal 28 and lever arm 27 to offer resistance to the liquid medium 17 as the pedals are moved through the medium, and to assist in generating a swirling action of the liquid. The pedals 28 may be optionally provided with flexible extensions 31 shown in dotted line in FIG. 3. The extensions 31 will increase the resistance to the liquid medium and the swirling action.

The hydro-massage swirling action of the liquid is accomplished by the occupant repeatedly stepping forward and down on the right foot pedal, shifting his center of gravity forward, and lifting his left foot, and then stepping backward and down on the left foot pedal, shifting the center of gravity backward, and lifting the right foot which causes the liquid to move in a counter-clockwise direction. The hydrodynamic resistance of the liquid to the moving body parts and the swirling action of the liquid on the stationary body parts provides a hydrotherapeudic massaging effect on the lower body of the occupant when exercising. The curved interior shape of the tank bottom surface and end walls facilitates swirling action of the liquid medium. The foot pedals may then be positioned with the left foot pedal forward, and the above procedure repeated to cause a clockwise swirling action.

While one particular exercise platform is illustrated as a preferred embodiment, it should be understood that other similar occupant propelled exercise apparatus which offer muscular resistance in the liquid medium which when operated simultaneously generate swirling action in the liquid, such as an exercycle or the like, may be installed within the tank without departing from the scope of the invention.

Figure 7:
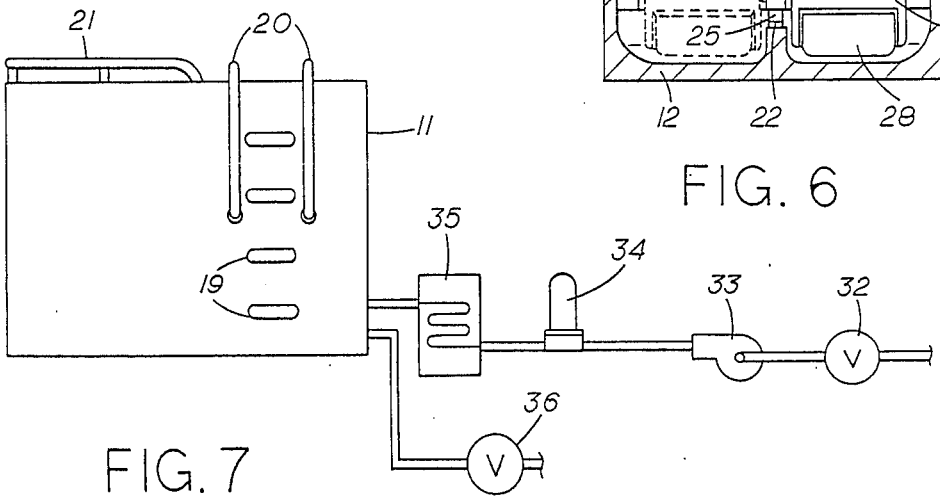
FIG. 7 is a schematic illustration of an aquatic exercise apparatus connected to a piping and heater system.

FIG. 7 shows schematically, an aquatic exercise apparatus 10 connected to a piping system. A typical piping system comprises an inlet valve 32, a pump 33, a water filter 34, a heater 35, and a drain valve 36. It should be understood that the tank 11 may also be provided with water jets for additional massaging action. A piping system is not necessary in all installations, due to the size and capacity of the tank. In some installations, the tank may be provided with a full hose and drain hose and simply connected to hot and/or cold water faucets by conventional mixing valve connections.

Figure 8:
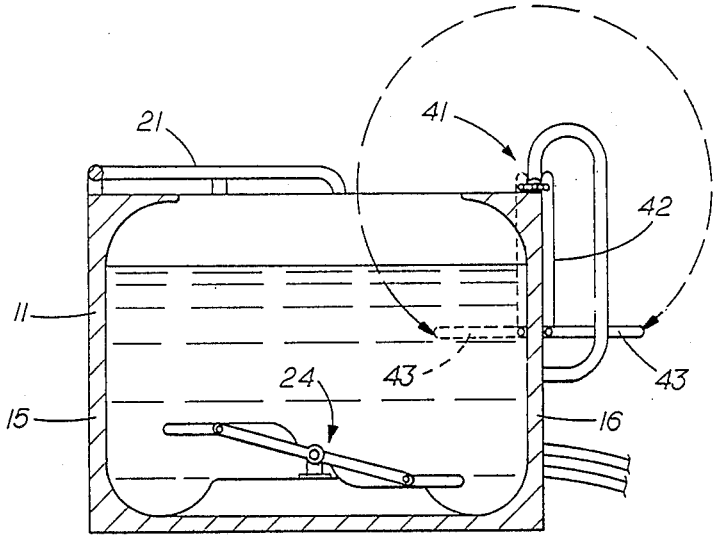
FIG. 8 is a side elevation in cross section of an alternate seating and step arrangement for the aquatic exercise apparatus.

FIGS. 8, 9, 10, and 11 illustrate various modifications of the aquatic exercise apparatus. The embodiment of FIG. 8 shows a movable platform attachment 41 which may be particularly useful for invalids. The platform 41 may be moved between a position outside the tank to serve as a step for entering the tank, and a position inside the tank to serve as a seat (shown in dotted line). The platform attachment 41 comprises a pair of parallel spaced vertical arms 42 having their top ends pivotally mounted at the top edge of the rear wall of the tank 11. A horizontal flat rectangular platform 43 is pivotally attached to extend transversly between the lower end of the arms 42. When the arms 42 are pivoted out of the tank and extend vertically adjacent the outside wall, the platform 43 extends outwardly therefrom to be used as a step to assist in tank entry, and when the arms 42 are pivoted into the tank adjacent the inside wall, platform 43 is pivoted to extend horizontally into the tank to be used as a seat to support the occupant or to take the weight off the legs.

Figure 9:
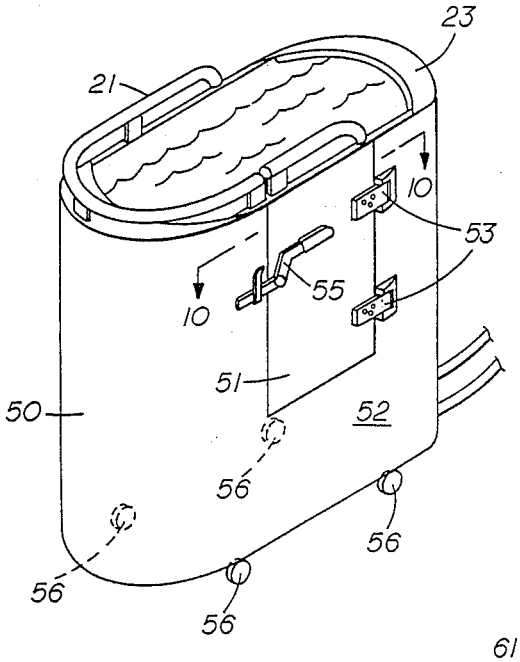
FIG. 9 is an isometric view of an alternate door arrangement for the aquatic exercise apparatus.
Figure 10:
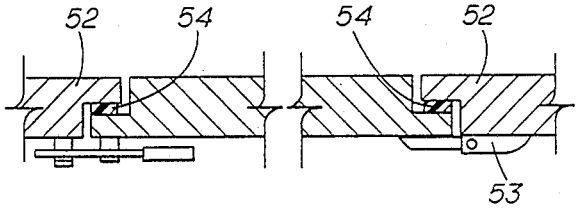
FIG. 10 is a cross sectional view of the door sealing details of the door arrangement of FIG. 9.

The embodiment of FIGS. 9 and 10 depict a tank 50 having a door 51 pivotally mounted in the side wall 52 by hinges 53. A water tight seal 54 around the opening seals the opening in the side wall, and a lever 55 secures the door in a water tight closed position. The side wall door arrangement allows safe easy entry into the tank. The tank 50 is shown supported on wheels 56 mounted on the bottom of the tank. It should be understood, that wheels could be installed on any of the tanks of the present invention for portability, due to their light weight and small size.

Figure 11:
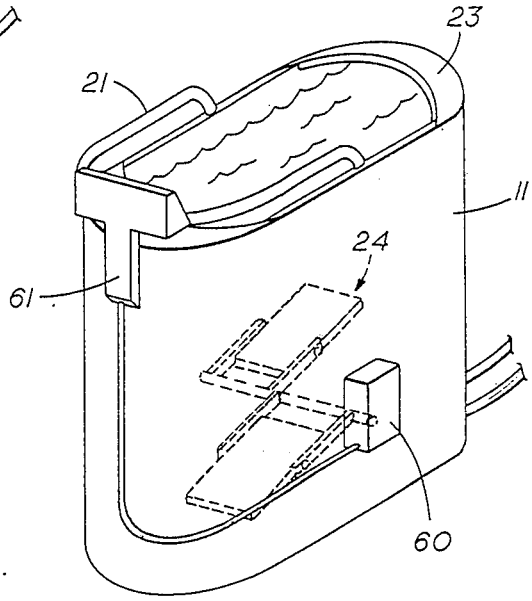
FIG. 11 is an isometric view of an aquatic exercise apparatus connected to a monotoring device.

FIG. 11 shows a tank in accordance with the present invention wherein the exercise platform 24 is connected to an electronic device 60 for driving the exercise apparatus, or for monotoring the speed at which the apparatus is being moved. The electronic device 60 may be operatively connected to a monotoring device 61 which may be also used with other devices attached to the occupant to monotor the cardiovascular activity or other physical characteristics during periods of exercise.

OPERATION

Figure 4:
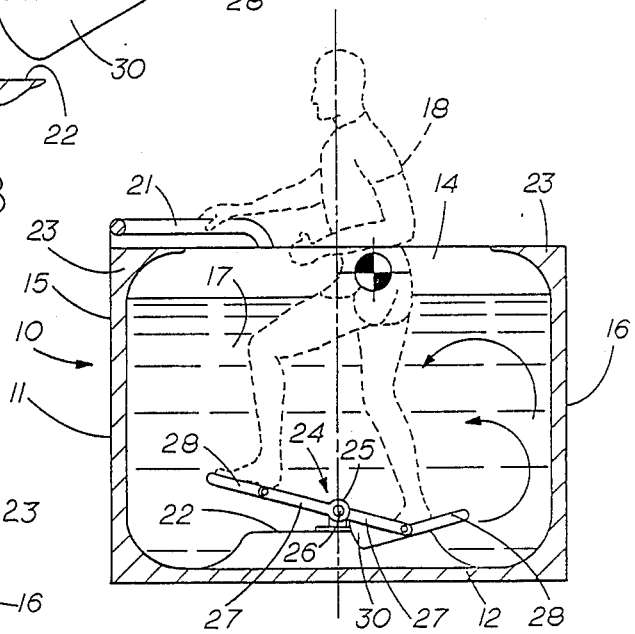
FIGS. 4 and 5 are side elevational views in cross section of the aquatic exercise apparatus in use.
Figure 5:
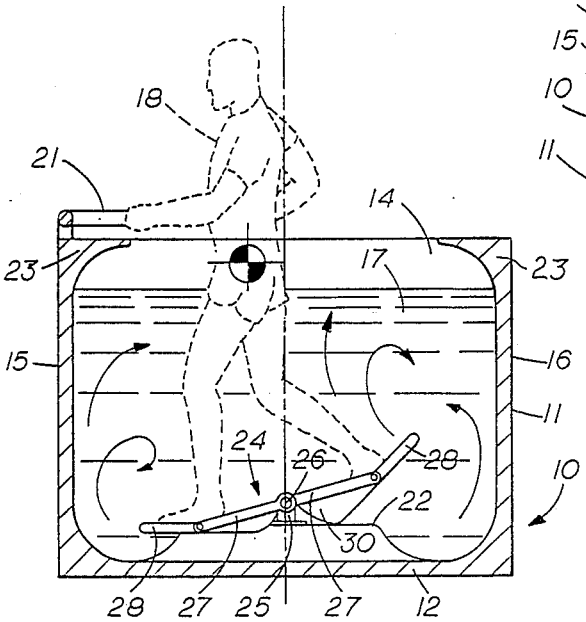

With reference to FIGS. 4 and 5, to use the aquatic exercise apparatus, a person enters the tank or is placed in the tank. The tank may be filled with the liquid medium before or after entry into the tank. The occupant grasps the hand rails and places one foot on each foot pedal. The occupant repeatedly steps forward and down on the right foot pedal, shifting his center of gravity forward, and lifting his left foot, and then stepping backward and down on the left foot pedal, shifting the center of gravity backward, and lifting the right foot simulating a rocking or jogging movement which causes the liquid to move in a counter-clockwise direction.

While the exercise provides the benefit of cardiovascular aerobic exercise, the hydrodynamic resistance of the liquid to the moving body parts provides dynamic physical stress on muscles to overcome the fluid resistance, and the swirling action of the liquid on the stationary body parts provides a hydrotherapeudic massaging effect on the lower body of the occupant when exercising. The curved interior shape of the tank bottom surface and end walls facilitates swirling action of the liquid medium. The foot pedals may then be positioned with the left foot pedal forward, and the above proceedure repeated to cause a clockwise swirling action.

The foot pedals and lever arms offer resistance as they are moved through the liquid and generate a swirling action within the enclosure. The pedals may be provided with flexible extensions to further increase the resistance and the swirling action.

The occupant when operating the exercise device in the liquid simultaneously produces hydrodynamic resistance, deflection of the liquid, fluid resistance, and generation of fluid currents and turbulence within the enclosure, and as a result of the movements of the occupant and the exercise device, the occupant receives a beneficial hydrotherapeudic massage on the submerged body portions by the liquid motion thus generated within the enclosure. Medicants may be introduced into the liquid medium to suppliment the beneficial effect of the hydrotherapeudic massage on the occupants submerged body portions. Additives may also be introduced into the liquid medium to alter the fluid flow and bouyancy characteristics of the liquid, and thereby increase or decrease the physical stress during exercise.

Sensing means may be coupled to the exercise device for monotoring the operation of the device, and sensors may be coupled to the occupant for monotoring the physical status of occupant during, and relative to, the operation of the exercise device.

While this invention has been described fully and completely with special emphasis upon a preferred embodiment, it should be understood that within the scope of the appended claims the invention may be practiced otherwise than as specifically described herein.

I claim:

1. A human aquatic exercise apparatus for strengthening muscles, improving muscle tone and coordination, and simultaneously providing hydrotherapeudic massage to a human occupant comprising;

an enclosure for receiving and retaining a quantity of liquid, said enclosure comprising a generally rectangular tank having an open top and hand grip means extending at least partially therearound, an enclosed bottom, and a continuous side wall, said bottom curved at its juncture with said side wall and having a longitudinally extending raised portion, said continuous side wall forming a pair of opposed spaced side walls and contigious curved end walls of sufficient dimension to substantially surround the lower body portion of a human occupant when standing therein and the top portion of said side and end walls curved inwardly to form a retaining ledge to prevent the liquid medium from being splashed out during periods of vigorous exercise, an exercise device secured within said enclosure on the raised bottom portion and having foot pedal means with liquid deflecting extensions to be operated by the human occupant while the lower body portion is submerged in said enclosure, said exercise device when operated by a human partially submerged in the liquid generating fluid currents which coact with the enclosure side walls, end walls, and bottom curvature and raised portion to produce hydrodynamic resistance, deflection of the liquid, fluid resistance, and generation of fluid currents and turbulence within the enclosure which massage the submerged body parts of the occupant, and a movable platform assembly comprising a pair of parallel spaced vertical arm members having their top ends pivotally mounted to the top edge of the side wall of said enclosure and a horizontal flat rectangular platform member pivotally attached to extend transversely between the lower end of the arms, said platform assembly capable of being pivoted between a position on the outside of the enclosure with said arm members extending vertically adjacent the outside wall and said platform member extending outwardly therefrom to be used as a step to assist in tank entry and a position inside the enclosure with said arm members adjacent the inside wall and said platform member extending horizontally into the enclosure to be used as a seat for supporting the weight of the occupant or to take the weight of the legs.

* * * * *